US008142209B2

(12) United States Patent
Zhu et al.

(10) Patent No.: US 8,142,209 B2
(45) Date of Patent: Mar. 27, 2012

(54) ELECTRICAL CONNECTOR WITH IMPROVED CONTACTS ARRANGEMENT

(75) Inventors: Zi-Qiang Zhu, Kunshan (CN); Jerry Wu, Irvine, CA (US); Hong-Qiang Han, Kunshan (CN); Chen-Qi Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/961,515

(22) Filed: Dec. 7, 2010

(65) Prior Publication Data

US 2011/0130014 A1 Jun. 2, 2011

Related U.S. Application Data

(63) Continuation-in-part of application No. 12/683,443, filed on Jan. 7, 2010, now Pat. No. 7,845,961.

(30) Foreign Application Priority Data

Jan. 7, 2009 (CN) ..... 2009 1 0300105

(51) Int. Cl.
*H01R 13/648* (2006.01)
*H01R 4/66* (2006.01)

(52) U.S. Cl. ..... 439/108; 439/607.05; 439/941; 439/79

(58) Field of Classification Search ..... 439/108, 439/607.05, 941, 79, 607.01, 607.27, 660, 439/101
See application file for complete search history.

(56) References Cited

U.S. PATENT DOCUMENTS

| | | | | |
|---|---|---|---|---|
| 7,303,410 | B2 | 12/2007 | Saito | |
| 7,435,110 | B2 * | 10/2008 | Xiao et al. | 439/107 |
| 2007/0238330 | A1 * | 10/2007 | Xiao et al. | 439/101 |

FOREIGN PATENT DOCUMENTS

| | | | |
|---|---|---|---|
| CN | 2909598 | Y | 6/2007 |
| CN | 2932689 | Y | 8/2007 |

* cited by examiner

*Primary Examiner* — Javaid Nasri

(74) *Attorney, Agent, or Firm* — Wei Te Chung; Andrew C. Cheng; Ming Chieh Chang

(57) ABSTRACT

An electrical connector (100) includes an insulative housing (1) having a base (11) and a tongue plate (12) protruding beyond the base (11); a set of contacts (2) having contacting portions (26) arranged in one row along one side of the tongue plate (12), the contacts (2) consisting of a first type of grounding contacts (G) and a second type of a set of pairs of differential contacts (24, 23, 22, 21), the differential contacts comprising a first pair of differential contacts (24) for bi-directionally transmitting data and a second pair of differential contacts (23) for unidirectionally transmitting data, in the contacting portions (26), the grounding contacts having at least two grounding contacts (G1, G2) arranged between the first pair of differential contacts (24) and the second pair of differential contacts (23); and a metal shell (3) covering the insulative housing (1) and having a receiving space (30) for the tongue plate (12) extending into.

20 Claims, 11 Drawing Sheets

ELECTRICAL CONNECTOR WITH IMPROVED CONTACTS ARRANGEMENT

This application is a continuation-in-part of a patent application Ser. No. 12/683,443 entitled "Electrical Connector with Improved Contacts Arrangement" filed on Jan. 7, 2010, now U.S. Pat. No. 7,845,961.

BACKGROUND OF THE INVENTION

1. Field of the Invention

The present invention relates to an electrical connector, and more particularly to electrical connectors with improved contacts arrangement.

2. Description of Related Art

Type C HDMI (High-Definition Multimedia Interface) connectors present as a medium being widely used in mobiles phones and other electronic devices for electrically connecting the electronic devices with each other to transmit signals. The type C HDMI connector has nineteen contacts arranged in one row and including three pairs of differential contacts (Data+、Data−), a pair of clock contacts (Clock+、Clock−), five grounding contacts, a CEC signal contact, a SCL signal contact, a SDA signal contact, a reserved signal contact, a +5V power contact, and a hot plug detect contact.

The type C HDMI connector has so many types of the contacts sorted in function that the chipset designed for the type C HDMI connector is complicated. The type C HDMI connector need many contacts to transmit the so many different types of data, and the manufacturing costs of the type C HDMI connector is increased.

Hence, an improved electrical connector with an improved contacts arrangement is desired to overcome the above problems.

BRIEF SUMMARY OF THE INVENTION

According to one aspect of the present invention, an electrical connector comprises an insulative housing having a base and a tongue plate protruding beyond the base; a plurality of contacts having contacting portions arranged in one row along one side of the tongue plate, the contacts consisting of a first type of grounding contacts and a second type of a plurality of pairs of differential contacts, the differential contacts comprising a first pair of differential contacts for bi-directionally transmitting data and a second pair of differential contacts for unidirectionally transmitting data, in the contacting portions, the grounding contacts comprising at least two grounding contacts arranged between the first pair of differential contacts and the second pair of differential contacts; and a metal shell covering the insulative housing and defining a receiving space for the tongue plate extending into.

According to another aspect of the present invention, an electrical connector comprises an insulative housing including a base with a tongue plate extending forwardly therefrom, an accessorial board unitarily configured to be seated upon a printed circuit board and formed on a bottom portion of the base and spaced, along a vertical direction, below the mating tongue in a parallel relation; a plurality of contacts disposed in the housing with contacting portions extending in a front-to-back direction, which is perpendicular to said vertical direction, and exposed upon a surface of said mating tongue under condition that said contacts are categorized with differential pairs and grounding contacts arranged in a transverse direction perpendicular to both said front-to-back direction and said vertical direction, at least two of said grounding contacts being arranged between adjacent two of said differential pairs; and a frame like metallic shell assembled to the housing and defining a receiving space for the tongue plate extending into, the receiving space being surrounded by a top wall, a bottom wall opposite to the top wall, a pair of opposed side walls at two sides thereof, and a pair of connecting walls bowed upwardly to connect the bottom wall and the corresponding side walls, the bottom wall locating in a higher position and getting closer to the top wall than the connecting walls, the bottom wall defining a plurality of resilient tangs unitarily extending therefrom into the receiving space and adapted to be outwardly deflected once a plug is inserted into the receiving space. Wherein said accessorial board has a pair of horizontal posts resisting the connecting walls upwardly and spaced from each other with therebetween a cavity dimensioned to allow outward and downward deflection of said resilient tangs when said plug is inserted into the receiving space.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is a front elevational view of the electrical connector shown in

FIG. 1;

DETAILED DESCRIPTION OF THE PREFERRED EMBODIMENT

Figure 1:
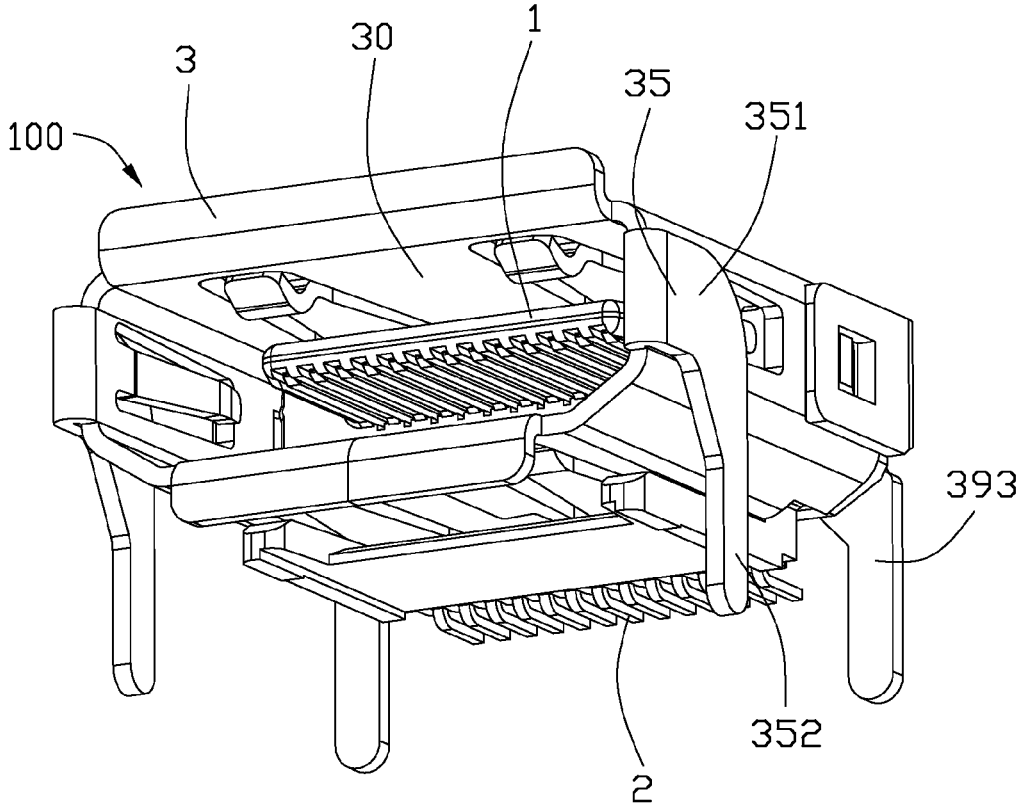
FIG. 1 is a perspective view of an electrical connector according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-5, an electrical connector 100 according to the present invention is disclosed. The electrical connector 100 includes an insulative housing 1, a plurality of contacts 2 retained in the insulative housing 1, and a metal shell 3 covering the insulative housing 1 and defining a receiving space 30 for receiving a matchable plug (not shown) which mates with the electrical connector 100. The metal shell 3 includes a front shell 38 and a rear shell 39 coupled to the front shell 38.

The insulative housing 1 being molded of dielectric material such as plastic or the like, has a base 11 and a tongue plate 12 extending horizontally forwardly from a front face of the base 11 into the receiving space 30. The base 11 has a depression portion 112 recessed from a middle position of a top face to retain the rear shell 39. The base 11 has four projections 116 extending outwardly from four corners of a rear face for preventing the front shell 38 from moving backwardly. The tongue plate 12 has an upper face 121, and a lower face 122 opposite to the upper face 121 and defining a set of passageways 1221 arranged alternatively thereon for receiving the contacts 2 respectively. In this embodiment, the tongue plate 12 is integrally formed with the base 11. The depression portion 112 has a bottom face which is approximately located at a same plane with the upper surface 121 of the tongue 12 for decreasing a height of the insulative housing 1. It is also to be understood that, in other embodiments, the tongue plate 12 and the base 11 can be molded of dielectric material respectively and assembled together to form the insulative housing 1. The insulative housing 1 has a an accessorial board 13 extending forwardly from bottom of the base 11 and located below the front shell 38 for supporting and strengthening the front shell 38. The accessorial board 13 is spaced apart from the tongue 12 along the height direction and parallel to the tongue 12. The accessorial board 13 has a pair of posts 135 for decreasing a contact area between the electrical connector 100 and a Printed Circuit Board (PCB, not shown), and a platform 136 located between the posts 135 and connecting the posts 135. The platform 136 has a slanted plane 137 for guiding the front shell 38.

Referring to FIGS. 1 to 5, the contacts 2 each having a same shape are arranged in one row along a transverse direction and consist of a first type of grounding contacts and a second type of a plurality of differential contacts. The grounding contacts comprise five grounding contacts G. The differential contacts comprise four pair of differential contacts including a first, a second, a third, and a fourth pair of differential contacts 24, 23, 22, 21. Each pair of differential contacts include a + data contact and a – data contact. Each pair of differential contacts arranged between each two adjacent grounding contacts G. Therefore, the interference between each two adjacent pair of the differential contacts can be reduced. The second, third, and fourth pair of differential contacts 23, 22, 21 unidirectionally transmit data, the first pair of differential contacts 24 are arranged at one side of the second pair of differential contacts 23 and bi-directionally transmit hybrid data. The four pair of differential contacts enable the electrical connector 100 to supply a wider transmission bandwidth and increase data transmission speed. The first pair of differential contacts 24 enable the electrical connector 100 to bi-directionally transmit a high-speed hybrid data. In this embodiment, the contacts 2 consist of a first grounding contact G, a first pair of differential contacts 24, a second grounding contact G, a second pair of differential contacts 23, a third grounding contact G, a third pair of differential contacts 22, a fourth grounding contact G, a fourth pair of differential contacts 21, and a fifth grounding contact G which are arranged orderly along the transverse direction of the insulative housing 1. The contacts 2 having five grounding contacts G and four pair of differential contacts consist of only two types in function, the chipset designed for the connector 100 will be simplified. Furthermore, the fewer amount of the contacts 2 can miniature the electrical connector 100.

Figure 2:
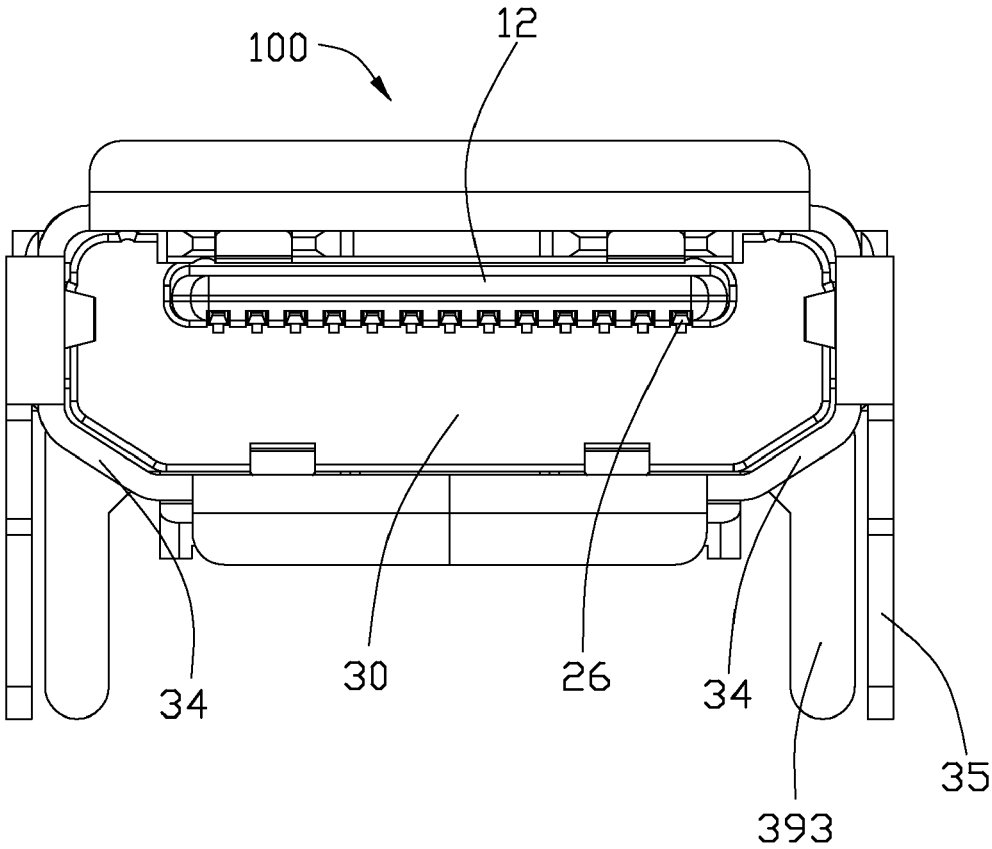
Figure 3:
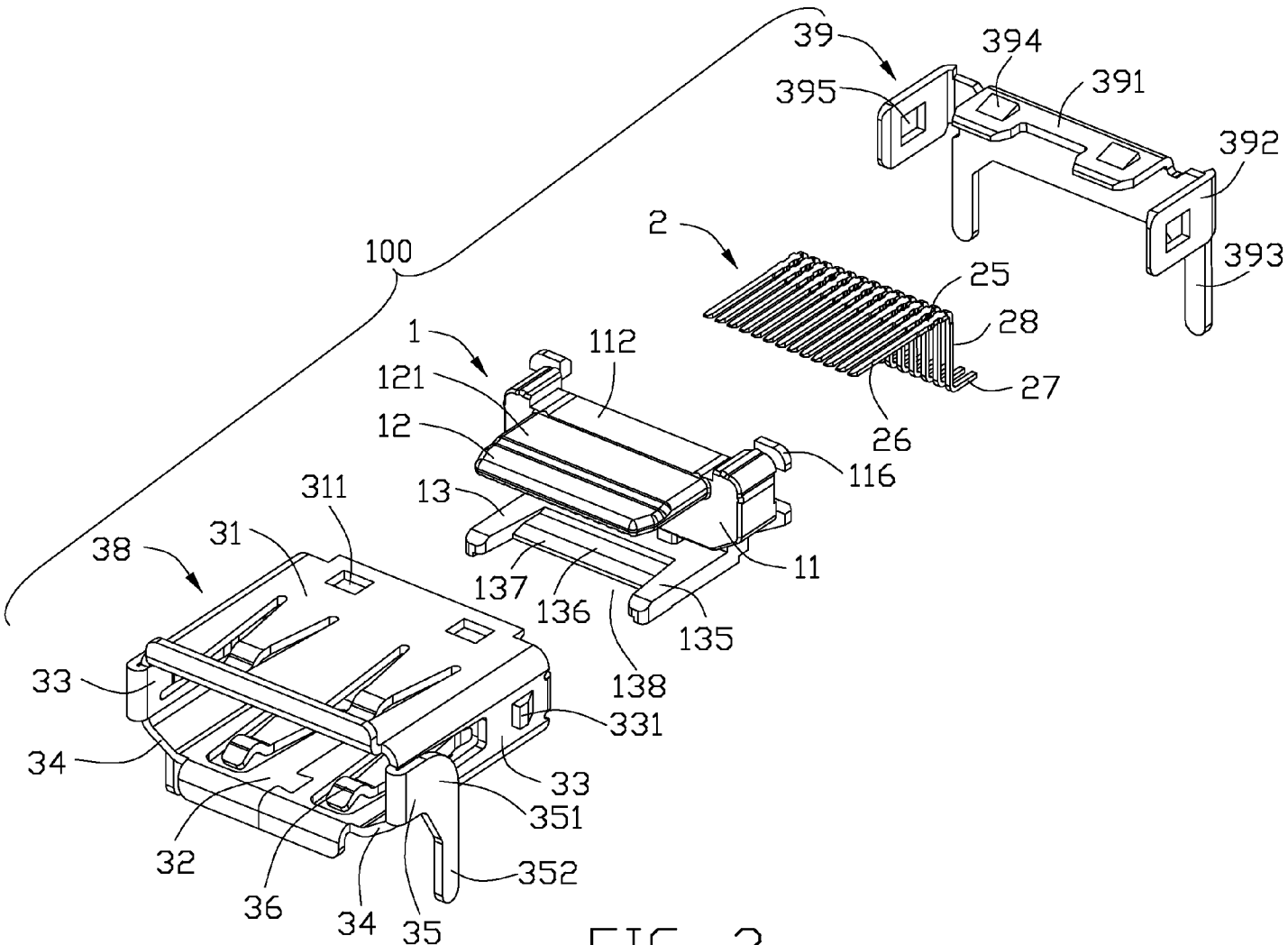
FIG. 3 is an exploded view of the electrical connector shown in FIG. 1.

Referring to FIG. 3, each contact 2 has a retaining portion 25 retained in the base 11, a flat contacting portion 26 received in the passageway 1221 and extending forwardly from a front end of the retaining portion 25, a tail portion 27 for being soldered directly onto a surface of the PCB, and a connecting portion 28 connecting the retaining portion 25 and the tail portion 27. The contacting portion 26 are exposed to the receiving space 30 to electrically mate with the matchable plug. The contacting portion 26 and the retaining portion 25 are arranged in a horizontal plane parallel to another horizontal plane in which the tail portion 27 are arranged, the connecting portions 28 are arranged in a vertical plane perpendicular to the contacting portions 26 and the tail portions 27. In another embodiment, the tail portions 27 can be mounted through holes of the PCB and extend vertically perpendicular to the contacting portions 26, the tail portions 27 can be arranged in two or three rows. Referring to FIG. 2, all of the contacting portions 26 are arranged in one row and received in the passageways 1221 on the lower face 122 of the tongue plate 12 so as to decrease thickness of the tongue plate 12 in a height direction.

In this embodiment, the contacts 2 are stamped from a contact carrier (not shown) and assembled to the insulative housing 1. In other embodiments, the contact 2 can be integrally molded into the insulative housing 1. Furthermore, the tongue plate 12 can be replaced by a printed circuit board (PCB), and gold fingers on the PCB will replace the contacting portion 26 to electrically mate with the matchable plug.

The front shell 38 has a top wall 31, a bottom wall 32, a pair of side walls 33, and a pair of connecting walls 34 connecting the bottom wall 32 and the side walls 33. The receiving space 30 is surrounded by the top wall 31, the bottom wall 32, the side walls 33, and the connecting walls 34. A set of resilient tangs 36 unitarily extend from the top wall 31, the bottom wall 32, and the side walls 33 and are adapted to be outwardly deflected once the plug is inserted into the receiving space 30. The bottom wall 32 is supported by the accessorial board 13. In this embodiment, the connecting walls 34 extend in an inclined plane and are higher than the bottom wall 32 so as to prevent the unmatchable plug from being inserted into the receiving space 30, in another embodiment, the connecting walls 34 can extend in a curve plane bending downwardly and lower than the bottom wall 32. The front shell 38 has a pair of first board locks 35 each including a bending portion 351 bending outwardly and backwardly from front edges of the corresponding side wall 33 and positioned along the corresponding side wall 33, and a leg 352 extending downwardly from a lower end of the corresponding bending portion 351 for being mounted onto the PCB.

Figure 4:
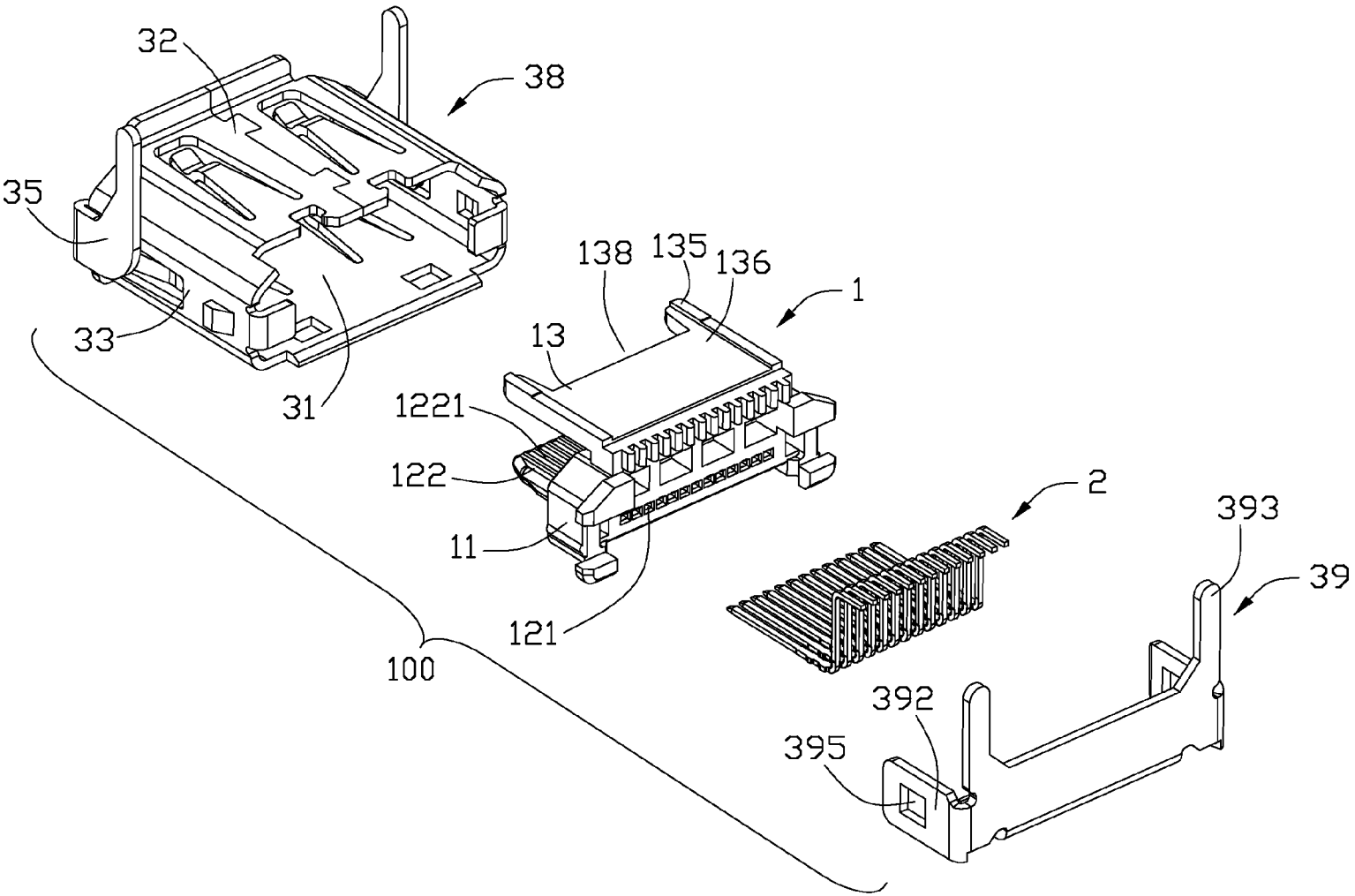
FIG. 4 is another exploded view of the electrical connector shown in FIG. 1.
Figure 5:
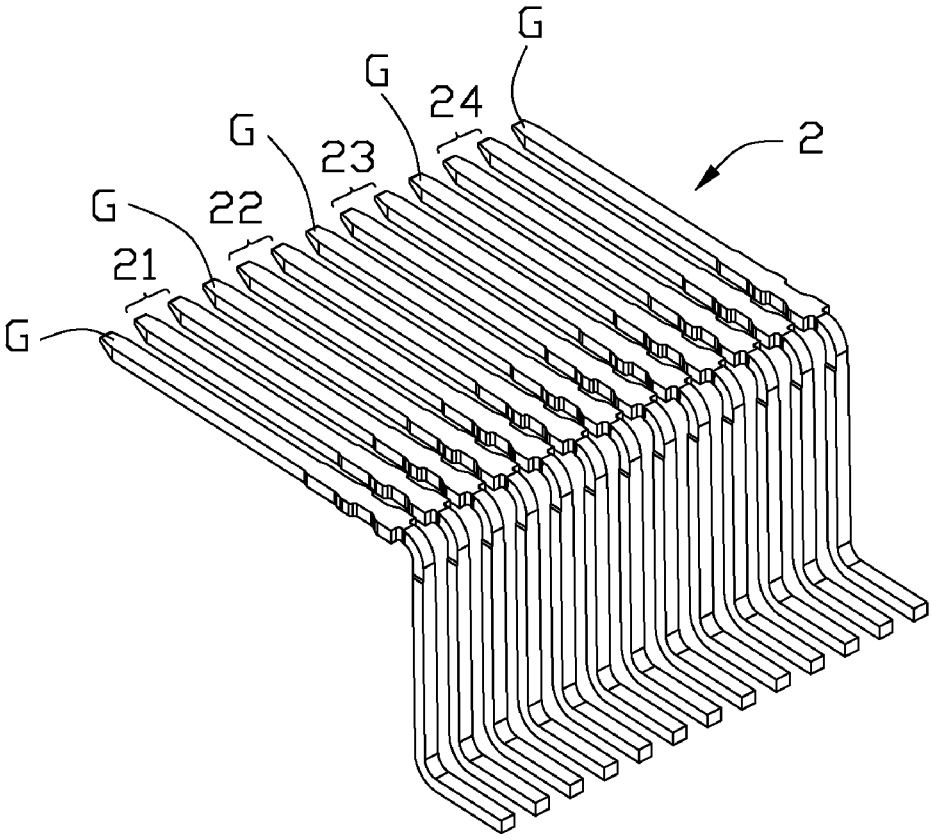
FIG. 5 is an enlarged perspective view of contacts of the electrical connector shown in FIG. 1.

Referring to FIG. 2-4, the rear shell 39 includes a first latching tab 391 extending horizontally and forwardly from an upper side thereof for being retained in the depression portion 112, a pair of second latching tabs 392 extending vertically and forwardly from two lateral sides thereof, and a pair of second board locks 393 extending downwardly from a lower end thereof for being mounted onto the PCB. The first latching tab 391 has a pair of protrusions 394 stamped upwardly therefrom for being latched into a pair of apertures 311 formed on the top wall 31. In this embodiment, the rear shell 39 is assembled to the front shell 38. In other embodiments, the rear shell 39 could be integrally formed with the front shell. Each second latching tab 392 has a groove 395 latched with an embossment 331 formed on the corresponding side wall 33. The second board locks 393 are located between the first board locks 35 and perpendicular to the first board locks 35.

Figure 6:
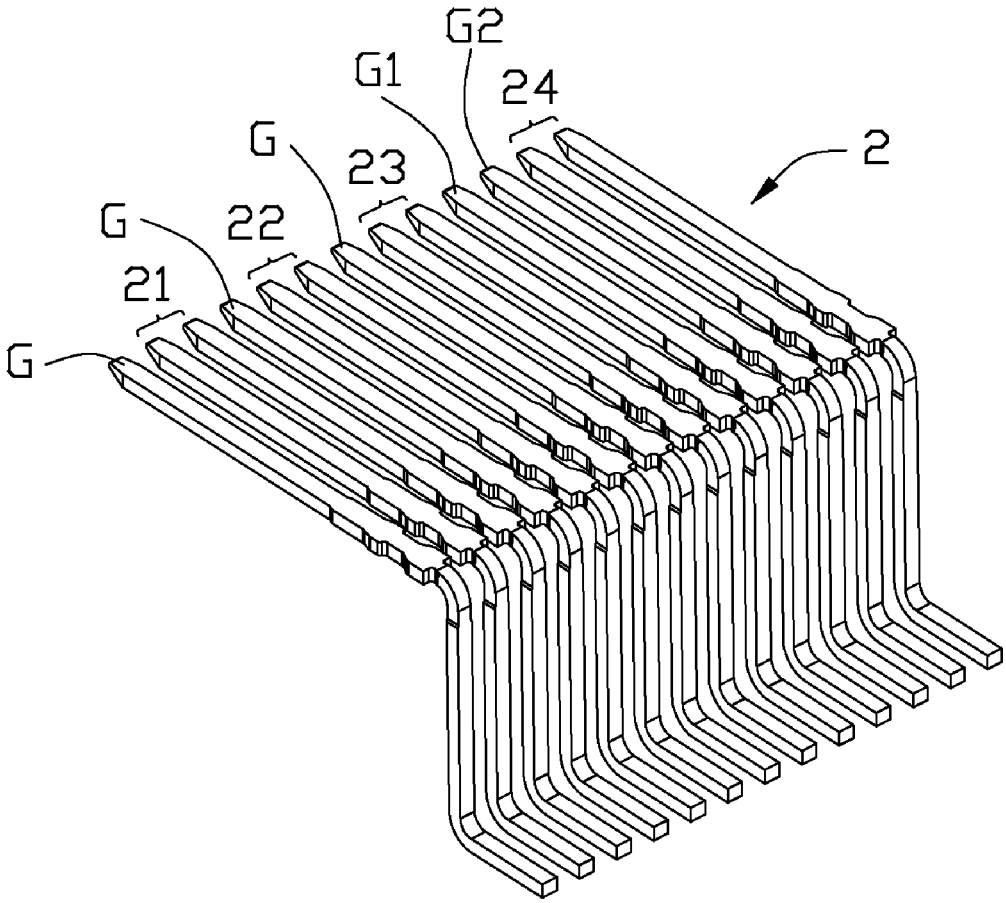
FIG. 6 is an enlarged perspective view of contacts of an electrical connector according to a second embodiment of the present invention.
Figure 7:
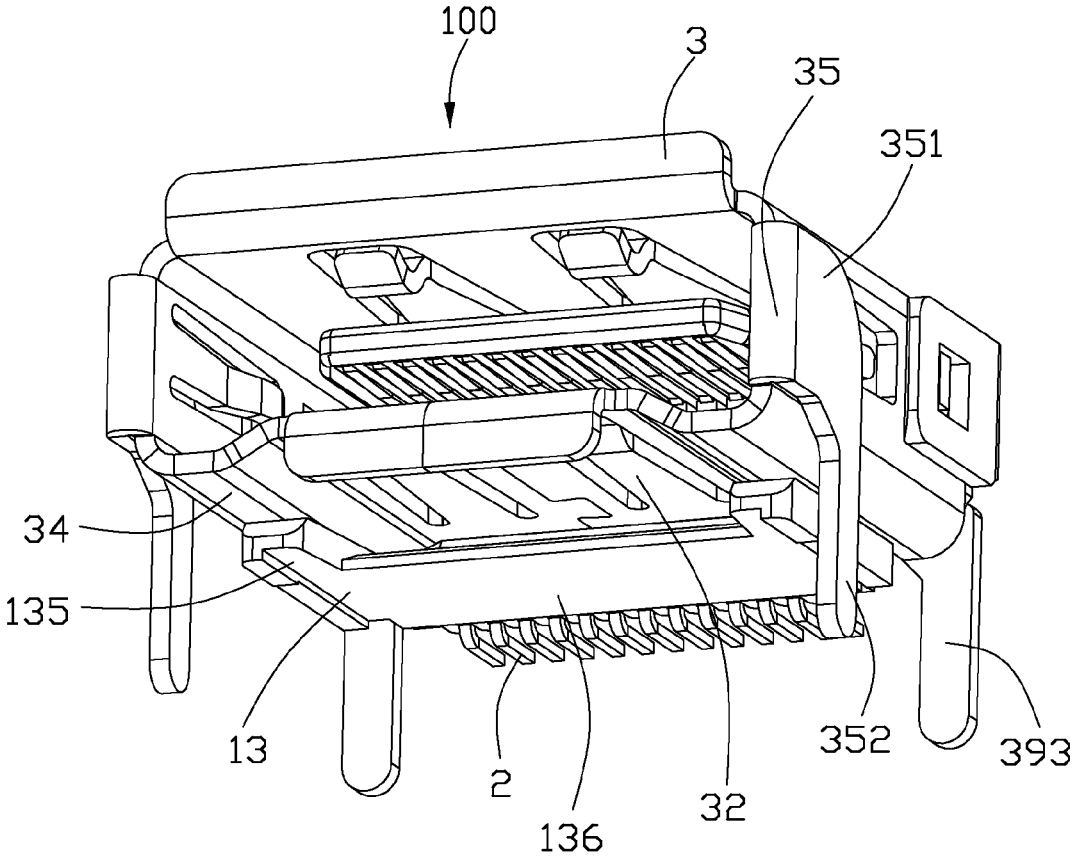
FIG. 7 is a perspective view of an electrical connector according to a third embodiment of the present invention.
Figure 8:
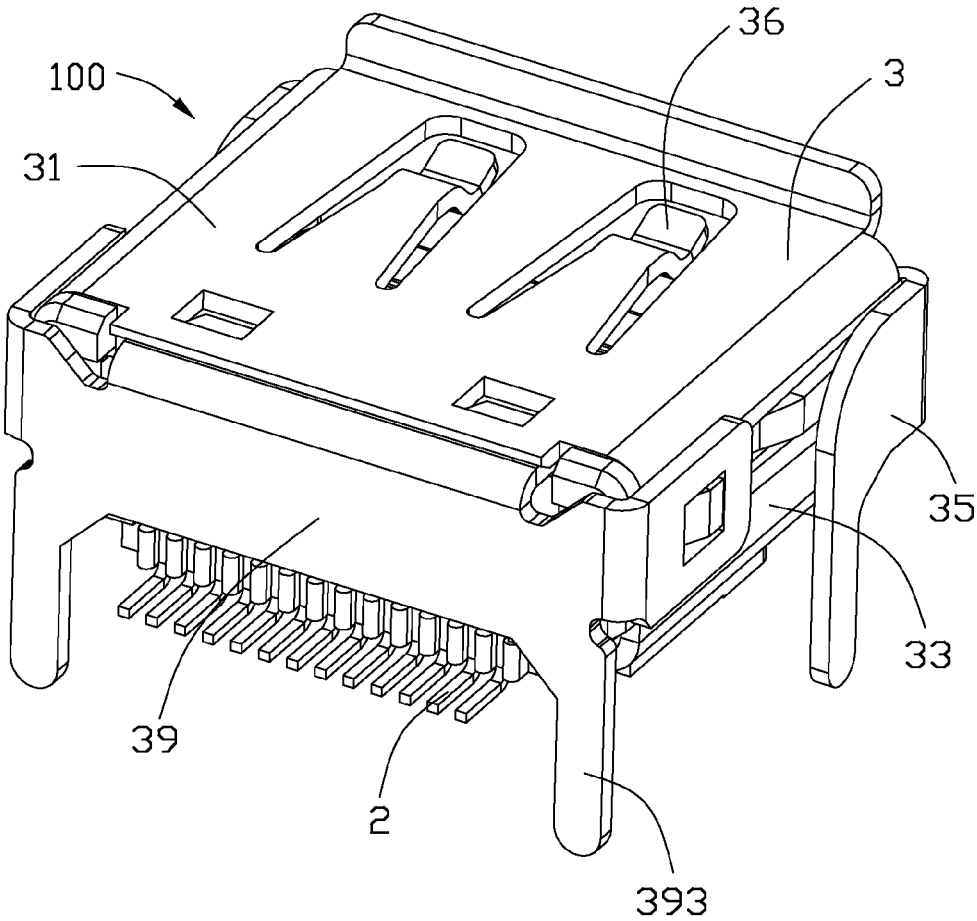
FIG. 8 is a view similar to FIG. 7, while taken from another aspect.
Figure 9:
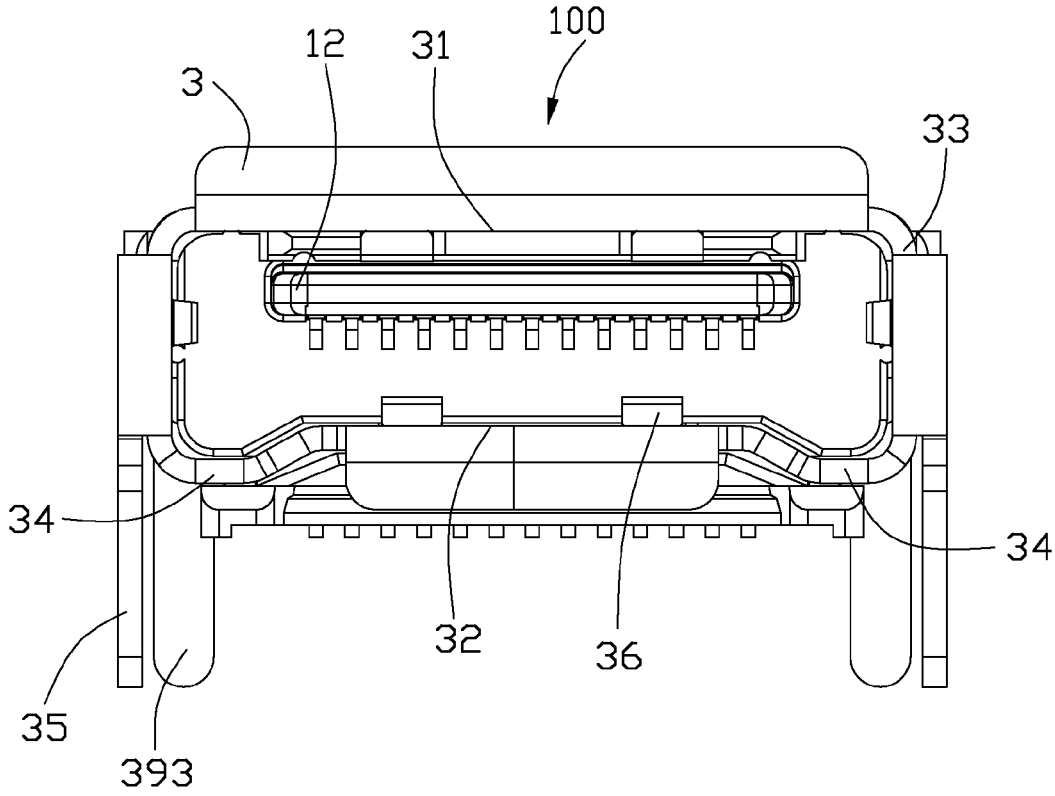
FIG. 9 is a front elevational view of the electrical connector shown in FIG. 7.
Figure 10:
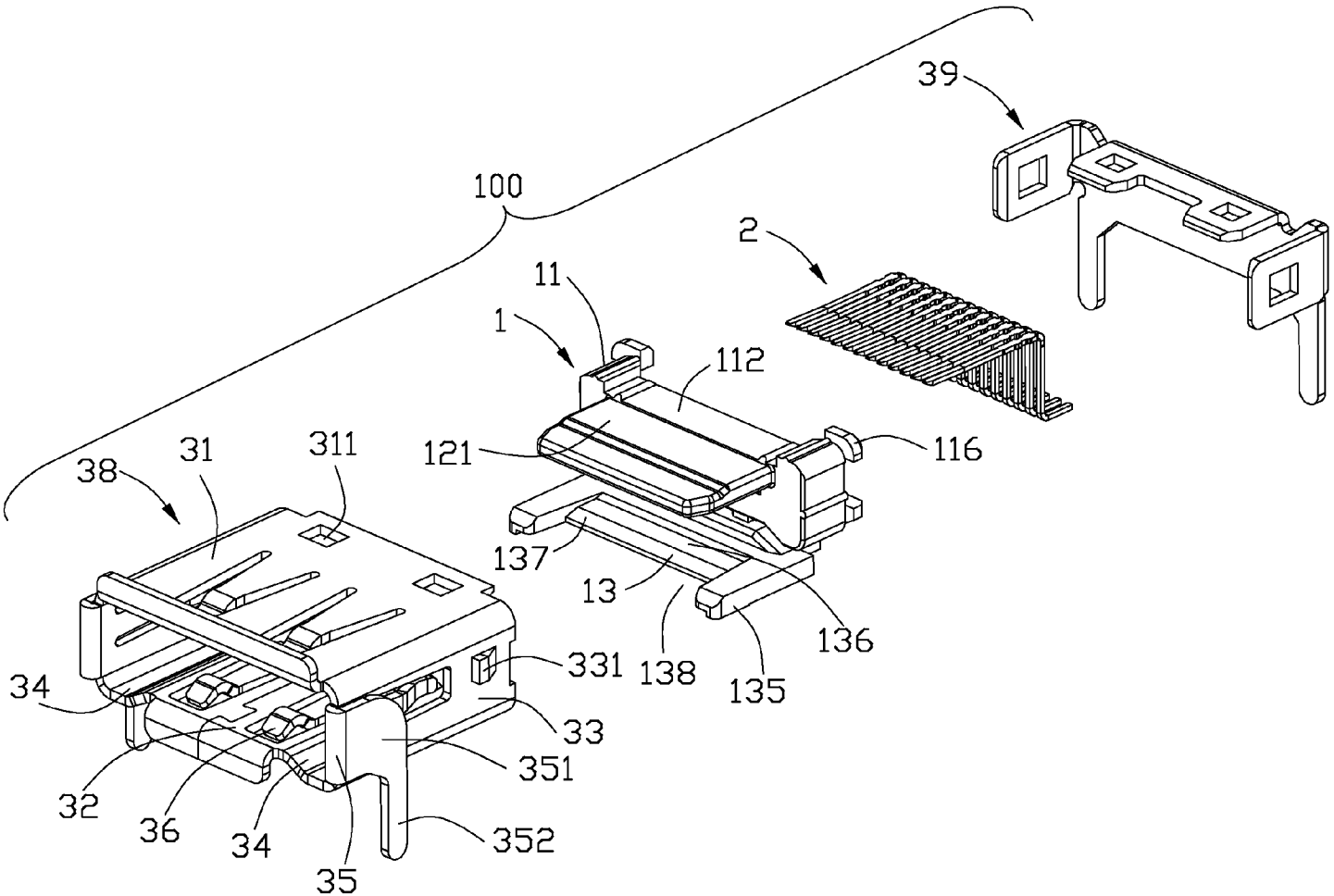
FIG. 10 is an exploded view of the electrical connector shown in FIG. 7.
Figure 11:
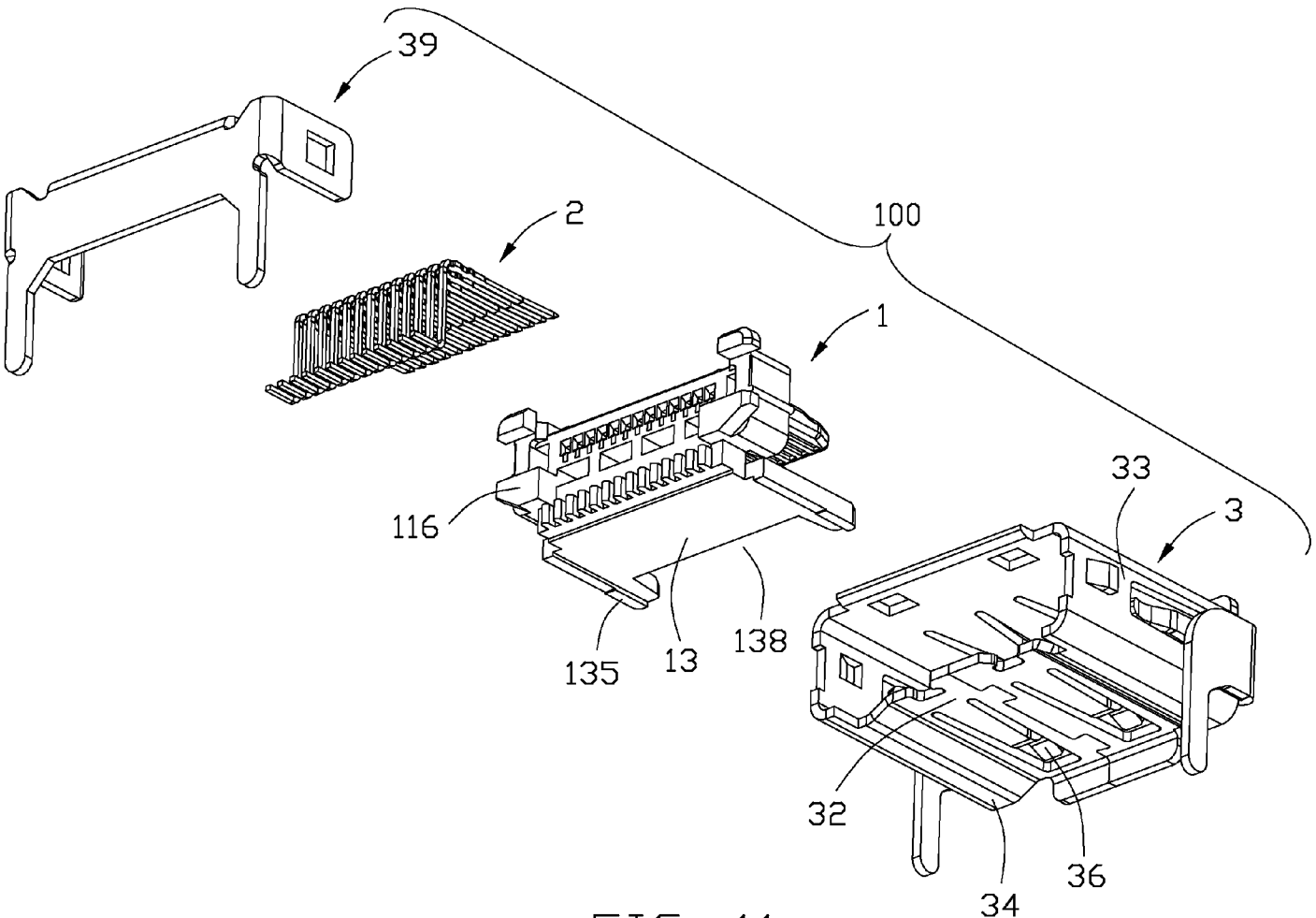
FIG. 11 is a view similar to FIG. 10, while taken from another aspect.

Referring to FIG. 6, the electrical connector in a second embodiment of the present invention, only the contacts 2 have been modified, therefore, the other components of the connector are not described. The second, the third, and the fourth pairs of differential contacts 23, 22, 21 which unidirectionally transmit data and three grounding contacts G are arranged alternatively, the second pair of differential contacts 23 are arranged at outside, a pair of grounding contacts G1, G2 are arranged between the second pair of differential contacts 23 and the first pair of differential contacts 24 which bi-directionally transmit hybrid data. The first pair of differential contacts 24 are located in an outermost side of the contacts 2. The grounding contact G1 of the two grounding contacts G1, G2 is arranged adjacent to the second pair of differential contacts 23, the other grounding contact G2 is arranged adjacent to the first pair of differential contacts 24. In this embodiment, the contacts consist of a first pair of differential contacts 24, a pair of first grounding contacts G1, G2, a second pair of differential contacts 23, a second grounding contact G, a third pair of differential contacts 22, a third grounding contact G, a fourth pair of differential contacts 21, and a fourth grounding contact G which are arranged orderly along the transverse direction of the insulative housing 1. The space between the first and the second pairs of differential contacts 24, 23 can be increased, the interference between the first and the second pairs of differential contacts 24, 23 can be reduced more effectively.

Referring to FIG. 7-11, the electrical connector in a third embodiment of the present invention, only the front shell 38 have been modified, therefore, the components which have same structures with the first embodiment are labeled same numerals as that of the first embodiment or not labeled. The connecting walls 34 extend in a curve plane and are bowed upwardly to connect the bottom wall 32 and the corresponding side walls 33. The bottom wall 32 locates in a higher position and gets closer to the top wall 31 than the connecting walls 34. The accessorial board 13 locates under the front shell 38, the posts 135 are spaced from each other and have a cavity 138 located therebetween for being dimensioned to allow outward and downward deflection of said resilient tangs 36 of the bottom wall 32 when the plug is inserted into the receiving space 30. The platform 136 which is located between the posts 135 and connects the posts 135 is located behind the resilient tangs 36 of the bottom wall 32 for facilitating assembling of the front shell 38 to the insulative housing 1. The posts 135 resist the connecting walls 34 upwardly with the bottom wall 32 located thereabove in the height direction and located therebetween in a transverse direction. The bottom wall 32 is further located above the platform 136 with a space formed therebetween. In this embodiment, It is obvious that the contacts 2 may have the same arrangement as that of the first embodiment best shown in FIG. 5 or as that of the second embodiment shown in FIG. 6.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing having a base and a tongue plate protruding beyond the base;

a plurality of contacts having contacting portions arranged in one row along one side of the tongue plate, the contacts comprising a plurality of grounding contacts and a plurality of pairs of differential contacts, the differential contacts comprising a first pair of differential contacts for bi-directionally transmitting data and a second pair of differential contacts for unidirectionally transmitting data, with respect to the contacting portions, the grounding contacts comprising at least two grounding contacts arranged between the first pair of differential contacts and the second pair of differential contacts; and a metal shell covering the insulative housing and defining a receiving space for the tongue plate extending into.

2. The electrical connector according to claim 1, wherein the differential contacts comprise third and fourth pairs of differential contacts for unidirectionally transmitting data, in the contacting portions, the grounding contacts further comprise three grounding contacts arranged alternately with the second, third and fourth pairs of differential contacts.

3. The electrical connector according to claim 2, wherein the first pair of differential contacts and one of the three grounding contacts are arranged at two outermost sides of the contacts.

4. The electrical connector according to claim 1, wherein one of the two grounding contacts is arranged adjacent to the first pair of differential contacts, the other one of the two grounding contacts is arranged adjacent to the second pair of differential contacts.

5. The electrical connector according to claim 1, wherein in the contacting portions, the contacts comprise a first pair of differential contacts, two grounding contacts, a second pair of differential contacts, a grounding contact, a third pair of differential contacts, a grounding contact, a fourth pair of differential contacts, and a grounding contact arranged in sequence along a transverse direction of the electrical connector.

6. The electrical connector according to claim 1, wherein each contact has a retaining portion extending from the contacting portion and retained in the base, a tail portion for being mounted on a printed circuit board, and a connecting portion connecting the retaining portion and the tail portion.

7. The electrical connector according to claim 6, wherein the contacting portions are arranged in a horizontal plane parallel to another horizontal plane in which the tail portions are arranged, the connecting portions are arranged in a intersectant plane intersecting with the horizontal planes.

8. The electrical connector according to claim 6, wherein the tail portions are arranged in one row or at least two rows and are perpendicular to the contacting portions for being mounted through holes of the printed circuit board.

9. The electrical connector according to claim 1, wherein the tongue plate has a set of passageways on the side thereof, the contacting portions of the contacts are assembled into the passageways.

10. The electrical connector according to claim 1, wherein the contacts are inserted molded into the insulative housing.

11. The electrical connector according to claim 1, wherein the metal shell comprises a front shell defining the receiving space, the receiving space is surrounded by a top wall, a bottom wall opposite to the top wall, a pair of opposed side walls, and a pair of connecting walls connecting the bottom wall and the side walls, the front shell has a pair of first board locks bending outwardly and backwardly from front edges of the corresponding side walls for being mounted onto to a printed circuit board.

12. The electrical connector according to claim 11, wherein the metal shell has a pair of second board locks located at back of the first board locks and located between the first board locks in a transverse direction for being mounted onto the printed circuit board.

13. The electrical connector according to claim 12, wherein the metal shell further comprises a rear shell attached to the front shell, the second board locks unitarily extend from the rear shell and are perpendicular to the first board locks.

14. An electrical connector defining a receiving space and comprising:

an insulative housing having a base, and a tongue plate protruding from the base and into the receiving space; and a plurality of contacts having contacting portions arranged in one single row along one side of the tongue plate, retaining portions extending from the contacting portions and retained in the base, and tail portions opposite to the contacting portions and extending out of the insulative housing; wherein the contacts consist of four pairs of differential contacts and five grounding contacts and arranged in the following specific sequence along a transverse direction of the electrical connector: a first pair of bi-directionally transmitting differential contacts, two grounding contacts, a second pair of unidirectionally transmitting differential contacts, a grounding contact, a third pair of unidirectionally transmitting differential contacts, a grounding contact, a fourth pair of unidirectionally transmitting differential contacts, and a grounding contact.

15. The electrical connector according to claim 14, wherein the contacting portion of each contact has a width wider than that of the corresponding tail portion in the transverse direction.

16. The electrical connector according to claim 14, wherein a metal shell comprises a top wall, a bottom wall opposite to the top wall, a pair of opposed side walls, and a pair of connecting walls connecting the bottom wall and the side walls for surrounding the receiving space, the metal shell has a pair of first board locks bending outwardly and backwardly from front edges of the corresponding side walls for being mounted onto to a printed circuit board.

17. An electrical connector comprising:

an insulative housing defining a lower platform and an upper mating tongue both extending horizontally and parallel to each other;

a metallic shell defining a frame enclosing the upper mating tongue, said frame including a bottom wall having a raised portion seated upon the lower platform; and a plurality of contacts disposed in the housing with contacting section exposed upon a same face of the mating tongue; wherein said contacts include four differential pairs and five grounding contacts essentially alternately arranged with each other along a transverse direction under condition that a first grounding contact and a second grounding contacts sandwich a first differential pair therebetween, the second grounding contact and a third grounding contact sandwich a second differential pair therebetween, the third grounding contact and the fourth grounding contact sandwich a third differential pair therebetween while the third differential pair and a fourth differential pair sandwich the fourth grounding contact and a fifth grounding contact therebetween.

18. The electrical connector as claimed in claim 17, further including a pair of front mounting legs unitarily extending from the shell.

19. The electrical connector as claimed in claim 18, wherein said pair of front mounting legs are backwardly bent from a front edge of the frame.

20. The electrical connector as claimed in claim 18, further including a pair of rear mounting legs essentially respectively aligned with the pair of front mounting legs in front-to-back direction perpendicular to said transverse direction.

* * * * *